United States Patent [19]

Guy, Jr.

[11] 4,391,052

[45] Jul. 5, 1983

[54] SNOW BLOWER

[76] Inventor: Burlin A. Guy, Jr., P.O. Box 83, Caroga Lake, N.Y. 12032

[21] Appl. No.: 333,727

[22] Filed: Dec. 23, 1981

[51] Int. Cl.[3] ..... E01H 5/04; E01H 5/09

[52] U.S. Cl. ..... 37/236; 37/261; 37/251

[58] Field of Search ..... 37/234, 236, 248–258, 37/270, 271, 220–223, 228

[56] References Cited

U.S. PATENT DOCUMENTS

| | | | |
|---|---|---|---|
| 1,754,322 | 4/1930 | Johnson | 37/270 X |
| 2,610,414 | 9/1952 | Vanvieu | 37/251 |
| 3,503,450 | 3/1970 | Day | 37/257 X |
| 4,057,916 | 11/1977 | Roemer | 37/223 |

FOREIGN PATENT DOCUMENTS

| | | | |
|---|---|---|---|
| 2277189 | 1/1976 | France | 37/234 |

*Primary Examiner*—E. H. Eickholt
*Attorney, Agent, or Firm*—Harvey B. Jacobson

[57] ABSTRACT

A horizontally elongated and laterally opening shroud is provided having one open longitudinal front side and one closed longitudinal rear side as well as opposite end mounting structures at least substantially closing the opposite ends of the shroud. A pair of spiral bladed rotary conveyor members are journalled in the opposite end portions of the shroud for simultaneous rotation about an axis extending longitudinally of the shroud and the closed rear side of the shroud includes a lateral outlet centrally intermediate the mounting structures and with which the horizontal axial inlet of a snow blower including an upwardly opening tangential outlet is registered. The opposite ends of the shroud include vertically adjustable transverse skids and the conveyor members are driven by a fluid motor supported from one of the mounting structures. The tangential outlet of the blower assembly has a horizontally curving outlet head journalled therefrom for adjustable positioning about an upstanding axis and the shroud includes rearwardly projecting mounting arm structure for pivotal support from a prime mower.

7 Claims, 4 Drawing Figures

SNOW BLOWER

BACKGROUND OF THE INVENTION

Various forms of rotary auger-equipped snow blowers heretofore have been provided, but many of these previously known snow blowers utilize one or more chain and sprocket or belt and pulley drive assemblies and, accordingly, require considerable maintenance. Further, many auger-equipped snow blowers utilize a single motor for driving the snow auger and blower assemblies thereof, whereas different snow conditions require the auger and blower to operate at different relative speeds. Also, many heavy duty snow blowers are constructed in a manner that does not enable them to operate efficiently to clean sidewalks and driveways of fallen snow without entering an adjacent road or highway and other heavy duty snow blowers are constructed in a manner which renders them difficult to utilize in cleaning small parking lots and other small paved areas. Accordingly, a need exists for an improved form of snow blower which may operate over extended periods of time without excessive maintenance, which may be operated in a fuel efficient manner, which will afford maximum safety in operation and which will enable the cleaning of small paved areas of snow in an efficient manner.

Examples of previously known forms of snow blowers including some of the general structural and operational features of the instant invention are disclosed in U.S. Pat. Nos. 2,587,415, 2,735,199, 3,045,369, 3,055,127 and 3,375,878.

BRIEF DESCRIPTION OF THE INVENTION

The snow blower of the instant invention has been designed to provide a safe, efficient, trouble-free and economical apparatus of the heavy duty type for removing snow from paved surfaces and the like.

The snow blower includes independently speed adjustable auger and blower drive motors and is therefore adoptable for efficient operation when removing different types of snow and the drive motors are directly coupled to the auger conveyors and blower rotor whereby the necessity of chains and sprockets or belts and pulleys is eliminated together with the additional maintenance requirements represented thereby.

The main object of this invention is to provide a snow blower which may be operated by a single person and which includes independently driveable auger and blower assemblies to enable most efficient operation in different types of snow.

Another object of this invention is to provide a snow blower including augers and a blower rotor which are substantially directly driven from corresponding hydraulic motors without the use of chains and sprockets or belts and pulleys and which therefore provides greater safety of operation.

Still another important object of this invention is to provide a snow blower which may be readily mounted upon the forward end of a conventional prime mover such as a truck.

A further object of this invention is to provide a snow blower in accordance with the preceding objects and which includes front to rear extending transverse opposite end skids supported from the shroud of the blower for vertical adjustment relative thereto.

Yet another important object of this invention is to provide a snow blower of a design such that it may be readily mounted from any suitable prime mover having a source of fluid under pressure.

A final object of this invention to be specifically enumerated herein is to provide a snow blower in accordance with the preceding objects and which will conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
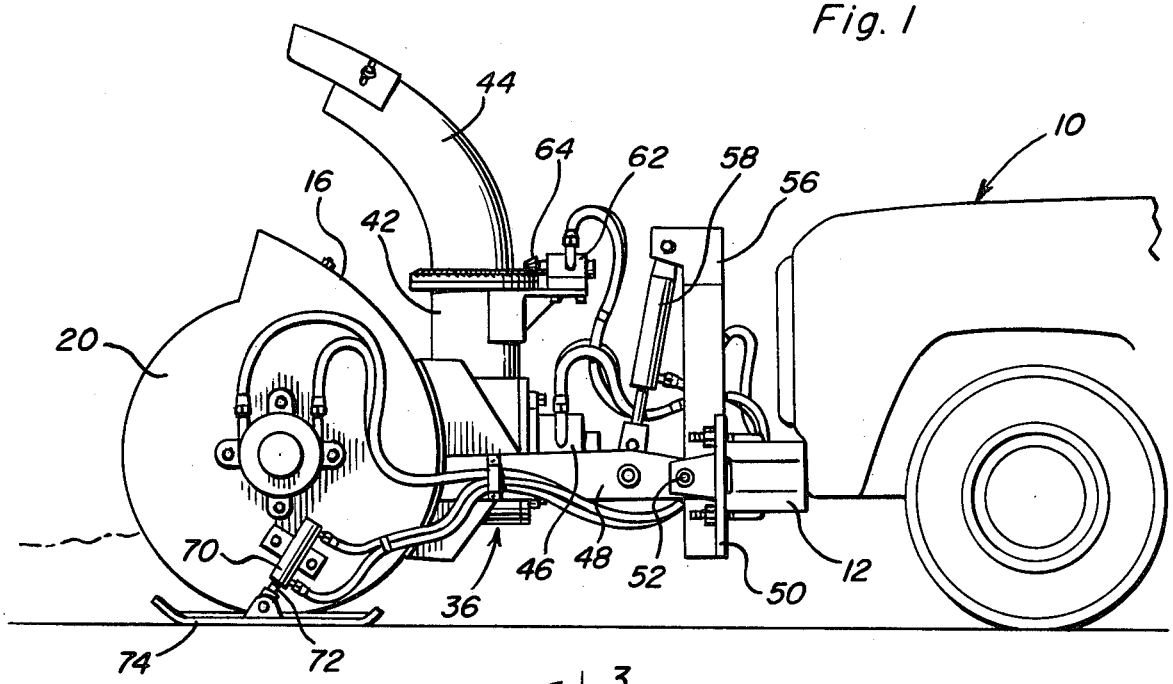
FIG. 1 is a left side elevational view of a snow blower constructed in accordance with the present invention and illustrated in operative association with the front end of a truck-type prime mover.
Figure 2:
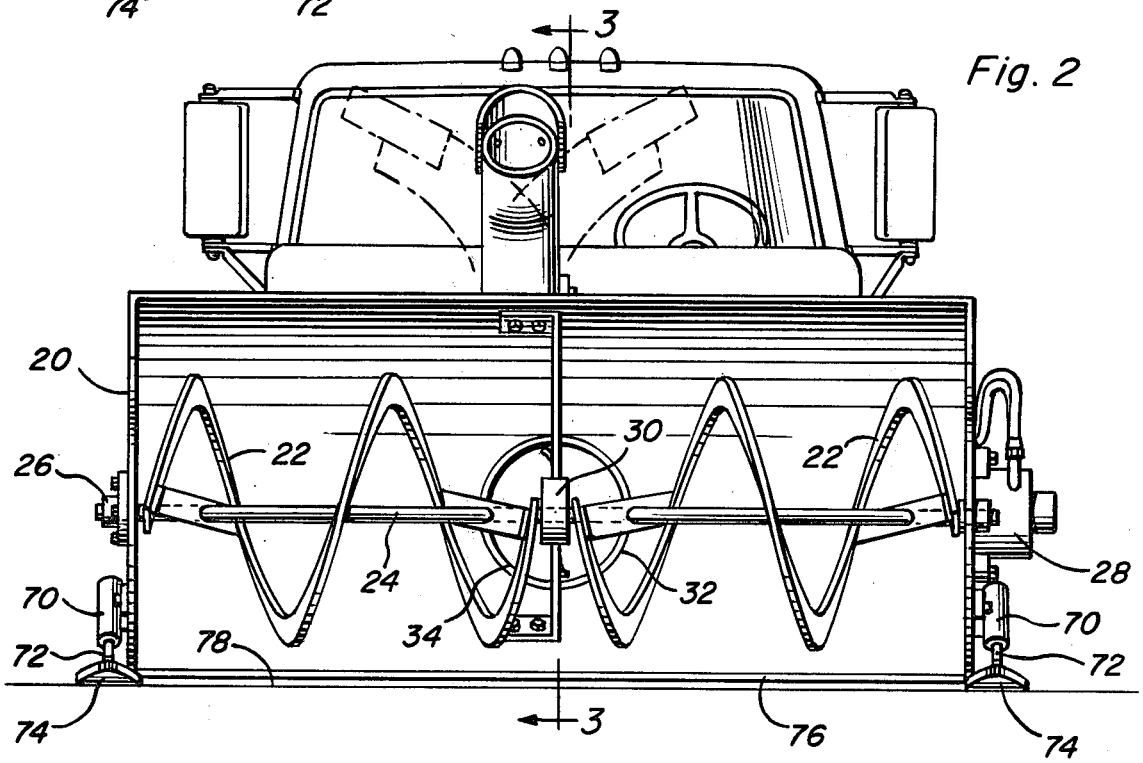
FIG. 2 is a front elevational view of the assemblage illustrated in FIG. 1.
Figure 4:
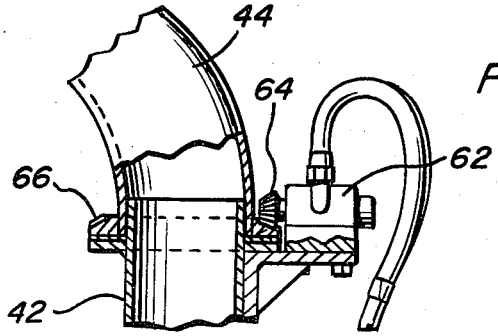
FIG. 4 is a fragmentary enlarged vertical sectional view illustrating the reversible hydraulic motor drive for the curved discharge chute of the blower.
Figure 3:
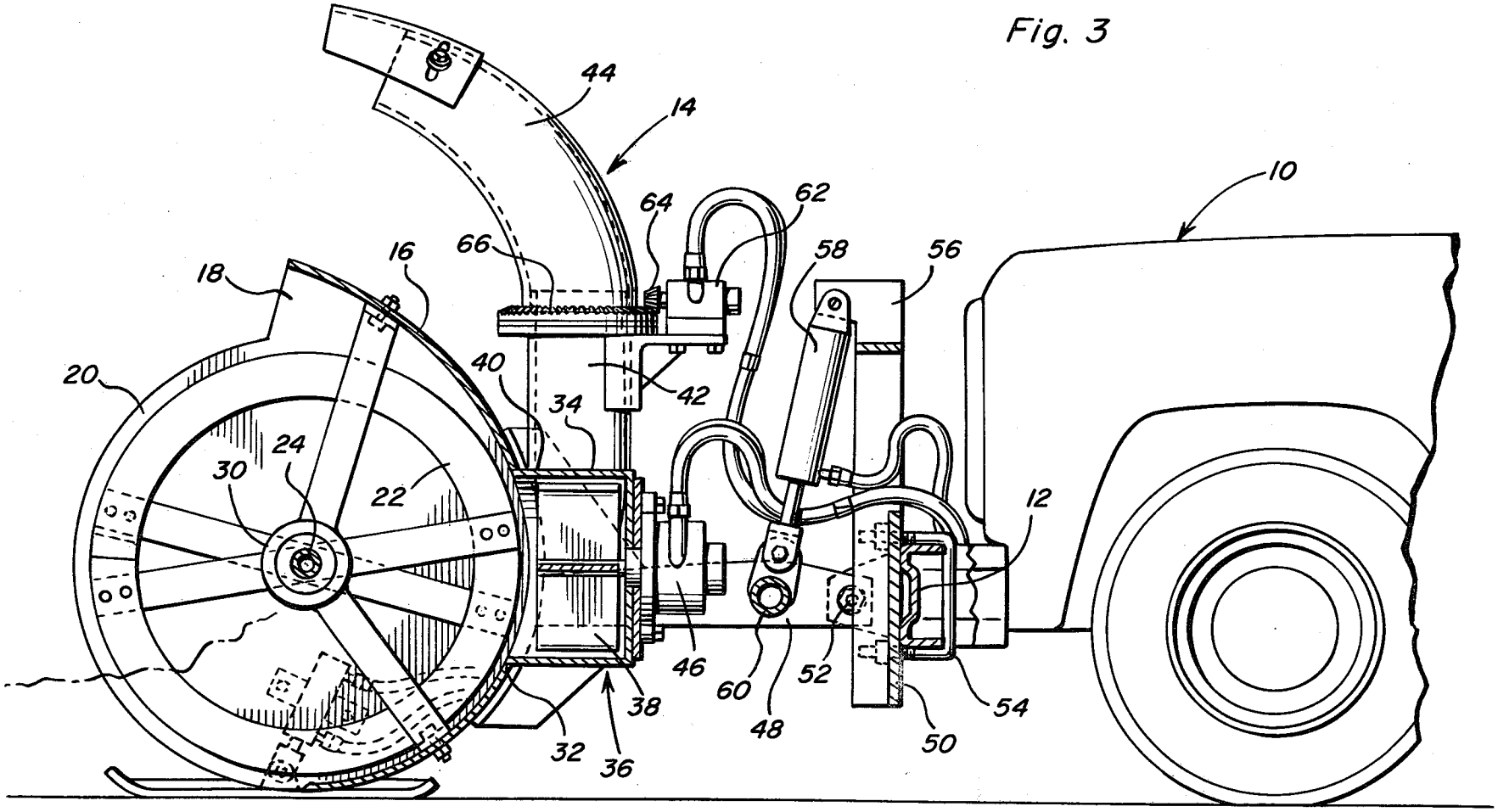
FIG. 3 is an enlarged vertical sectional view taken substantially upon the plane indicated by the section line 3—3 of FIG. 2.

Referring now more specifically to the drawings, the numeral 10 generally designates a truck-type prime mover including a front bumper 12 supported from its forward end and which includes a suitable source (not shown) of fluid under pressure.

The snow blower of the instant invention is referred to in general by the reference numeral 14 and includes a laterally and forwardly opening elongated transversely extending horizontal shroud 16 open at its front side 18 and closed at its rear side. The opposite ends of the shroud include end walls 20 defining mounting structures closing the opposite ends of the shroud 16.

A pair of auger members 22 are mounted on a support shaft 24 extending longitudinally of the shroud 16 and having one end journalled from one end wall 20 by a journal bearing 26 and the other end journalled from the other end wall 20 by a variable speed hydraulic motor 28. The shroud 16 includes a center bearing assembly 30 which journals the central portion of the shaft 24 and the closed rear side of the shroud 16 includes a discharge opening 32 formed therein with which the axial inlet 34 of an axial inlet and tangential outlet blower assembly referred to in general by the reference numeral 36 is registered. The blower assembly 36 includes a rotary impeller journalled therein within the axial inlet 40 of the blower assembly 36 and the blower assembly further includes a tangential outlet 42 which opens substantially vertically upwardly and has a horizontally curving tubular outlet head 44 journalled therefrom for rotation about a vertical axis. A variable speed hydraulic motor 46 is included with the blower assembly 36 and is drivingly coupled to the impeller 38. In addition, the shroud 16 includes a pair of rearwardly projecting support arms 48 whose rear ends are pivotally supported from a mounting bracket 50 carried by the front bumper 12.

Suitable pivot bolts or fasteners 52 pivotally attach the rear ends of the support arms 48 to the bracket 50 and the bracket 50 is mounted on the front bumper 12 through the utilization of U bolts 54 or other suitable mounting structure. In addition, bracket 50 includes a central upstanding portion 56 and the upper end of a double-acting hydraulic cylinder 58 is pivotally supported from the upper end of the upstanding portion 56 and the lower end of the hydraulic cylinder 58 is pivotally anchored relative to a cross brace 60 extending between the support arms 48 forward of the pivot fasteners 52.

A reversible hydraulic motor 62 is mounted on the tangential outlet 42 and includes a bevel gear equipped rotary output shaft 64 meshed with a ring gear 66 carried by the head 44. Accordingly, the head 44 may be adjustably angularly displaced about its axis of rotation, as desired.

The opposite end walls 20 of the shroud 16 include double-acting hydraulic cylinders 70 disposed in forwardly and downwardly inclined position supported therefrom and including downwardly extendable and upwardly retractable piston rod portions 72 from whose lower ends front to rear extending skids 74 are pivotally attached. The skids 74 may be vertically adjusted in order to adjust the vertical clearance between the forward lower edge 76 of the shroud 16 and the surface 78 engaged by the undersurfaces of the skids 74.

The hydraulic motor 28 comprises a variable speed motor as do the motors 46 and 62. The motors 28, 46 and 62 may be connected to the aforementioned suitable source of fluid under pressure through the utilization of appropriate throttle and reversing valves (not shown) and the cylinders 70 may also be suitably connected to the aforementioned source of fluid under pressure. Further, the hydraulic cylinder 58 may be likewise connected to the source of hydraulic fluid under pressure.

In operation, the speed of the motor 46 may be adjusted according to the type of snow being handled and the forward speed of the prime mover 10 independent of the speed of operation of the hydraulic motor 28. Each of the motors 28 and 46 may have its speed of operation adjusted to provide maximum efficiency in blowing the particular snow being handled. In addition, the hydraulic motor 62 may be actuated to cause the head 44 to be rotated to the desired position and the hydraulic cylinder 58 may be actuated to raise and lower the shroud 16 independent of actuation of the cylinders 70. Of course, the cylinders 70 are operated to maintain minimum desired clearance between the edge 76 and the surface 78. Further, the shaft 24 may comprise a pair of half shafts each driven by a hydraulic motor 28 supported from the corresponding end wall and the center bearing assembly may include a pair of bearings, possibly axially spaced apart journalling the adjacent shaft ends.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A snow blower assembly including a horizontally elongated and laterally opening shroud having one open longitudinal front side and one closed longitudinal rear side as well as opposite end mounting structures at least substantially closing the opposite ends of said shroud, a pair of spiral bladed rotary conveyor members journalled in the opposite end portions of said shroud for simultaneous rotation about an axis extending longitudinally of said shroud, said closed side including a lateral outlet formed therein centrally intermediate said mounting structures and opening rearwardly outwardly of said shroud, a horizontal axial inlet and upwardly opening tangential outlet blower assembly supported relative to said closed side of said shroud and including a rotary impeller registered with said lateral outlet, first and second fluid motors drivingly coupled to said rotary conveyor members and said rotary impeller, each of said first and second fluid motors being of the variable speed type, a pair of opposite end laterally extending horizontal skids carried by opposite ends of said shroud and projecting slightly below the lower periphery of said shroud, rearwardly projecting arm means carried by said shroud, a prime mover including front and rear ends, means pivotally supporting the rear ends of said arm means from said prime mover for angular displacement about a horizontal axis generally paralleling the first mentioned axis, first motor means operatively connected between said arm means and said prime mover for adjustably angularly displacing said arm means relative to said prime mover, said tangential outlet including a horizontally curving outlet head rotatably supported therefrom for rotation about an upstanding axis concentric with said tangential outlet, and second motor means operatively connected between said outlet head and said tangential outlet for adjustably angularly displacing said head relative to said tangential outlet, support means supporting said skids from said shroud for vertical adjustment relative thereto, said support means including fluid motor means for adjustably shifting said skids relative to said shroud.

2. The snow blower of claim 1 wherein said spiral bladed rotary conveyor members are carried by a single shaft extending longitudinally of said elongated shroud, the opposite ends of said shroud being journalled from said opposite end mounting structures.

3. The snow blower of claim 2 wherein said shroud includes a central journal bearing supported therefrom intermediate the opposite ends of said shroud and from which the longitudinal mid-portion of said single shaft is journalled.

4. The snow blower of claim 1 wherein said first and second fluid motors are directly drivingly connected to said rotary conveyor members and said rotary impeller.

5. The snow blower of claim 4 wherein said opposite end skids are carried by forwardly and downwardly extendable and upwardly and rearwardly retractable piston rod portions of a pair of double-acting hydraulic cylinders carried by said opposite end mounting structures and comprising said support means.

6. The snow blower of claim 5 wherein said spiral bladed rotary conveyor member are carried by a single shaft extending longitudinally of said elongated shroud, the opposite ends of said shroud being journalled from said opposite end mounting structures.

7. The snow blower of claim 6 wherein said shroud includes a central journal bearing supported therefrom intermediate the opposite ends of said shroud and from which the longitudinal mid-portion of said single shaft is journalled.

* * * * *